US006009885A

United States Patent [19]

Nam

[11] Patent Number: 6,009,885

[45] Date of Patent: Jan. 4, 2000

[54] POWDER PUFF CASE FOR POWDER ADHESION

[75] Inventor: Ho Keun Nam, Seoul, Rep. of Korea

[73] Assignee: Pacific Corporation, Seoul, Rep. of Korea

[21] Appl. No.: 09/245,502

[22] Filed: Feb. 5, 1999

[30] Foreign Application Priority Data

Sep. 10, 1998 [KR] Rep. of Korea ..... 98-17237

[51] Int. Cl.[7] ..... A45D 33/00; A45D 42/02

[52] U.S. Cl. ..... 132/293; 132/305

[58] Field of Search ..... 132/293, 294, 132/298, 303, 305, 306, 307

[56] References Cited

U.S. PATENT DOCUMENTS

| | | | |
|---|---|---|---|
| 1,532,830 | 4/1925 | Marceau | 132/293 |
| 1,534,870 | 5/1925 | Roystone | 132/293 |
| 1,553,049 | 9/1925 | Romero | 132/305 |
| 1,600,313 | 9/1926 | Callowhill | 132/293 |
| 2,149,183 | 2/1939 | Reilly | 132/293 |
| 4,162,010 | 7/1979 | Hovsepian | 206/823 |
| 4,917,131 | 4/1990 | Contreras, Sr. | 132/301 |
| 4,982,751 | 1/1991 | Oishi et al. | 132/299 |
| 5,865,194 | 2/1999 | Gueret | 132/299 |

FOREIGN PATENT DOCUMENTS

| | | | |
|---|---|---|---|
| 6-181812 | 7/1994 | Japan | A45D 3/00 |

*Primary Examiner*—John J. Wilson
*Assistant Examiner*—Robyn K Doan
*Attorney, Agent, or Firm*—Skjerven, Morrill, MacPherson, Franklin, & Friel LLP; Alan H. MacPherson

[57] ABSTRACT

A powder puff case for powder adhesion is provided to permit face powder to directly and uniformly adhere to a powder puff through an adhesion net when turning upside down and shaking a powder case that is filled with face powder. The adhesion net may be injection-molded integrally at bottom of the powder puff case, or outer circumference of the adhesion net is bent upward, to be received into a middle portion of bottom of the powder puff case, and a support body is inserted into bottom of the powder puff case, to hold the outer circumference of the adhesion net. Here, the adhesion net, the powder puff case, and the support body are in contact with one another by ultrasonic joint, etc. This powder puff case has a simple adhesion structure, in that meshes of the adhesion net are not stopped up and there is no separate case to hold face powder. Accordingly, face powder directly and uniformly adheres through the adhesion net to the powder puff from the main body.

6 Claims, 5 Drawing Sheets

POWDER PUFF CASE FOR POWDER ADHESION

BACKGROUND OF THE INVENTION

1. Field of the Invention

The present invention relates to a makeup case for accepting face powder and a powder puff. More particularly, it relates to a powder puff case for powder adhesion, which allows face powder to uniformly adhere to a powder puff through an adhesion net when turning upside down and shaking a powder case that holds face powder.

2. Description of the Related Art

Cosmetics such as face powder serve to prevent a skin from being sticky with moisture like sweat. Women touch the face powder onto their faces by using a powder puff. Referring to FIGS. 1 and 2, the following description will schematically relate to conventional powder cases.

FIG. 1 is an exploded, perspective view of a preferred embodiment of a conventional powder case 10 for accepting face powder. The powder case 10 includes: a main body 11 having face powder 12 therein; a plastic powder puff case 13 having a plurality of round apertures zap for powder adhesion on its bottom; a powder puff 13*a* that is received in the powder puff case 13; and a lid 14 that threadingly engages the main body 11. In using the powder case 10 by coupling the powder puff case 13 with the main body 11, the powder case 10 is turned upside down and shaken, the face powder 12 contained in the main body 11 proceeds onto the bottom of the powder puff case 13 by means of apertures 13*a*.

Accordingly, in putting on makeup, a user lifts up the lid 14 and puts his fingers in a tab 15*a* of powder puff 15 to get the face powder that has collected the bottom of the powder puff case 13 onto the powder puff 15.

The powder puff case 13 of FIG. 1, which is entirely made of plastic, has a construction which supplies the face powder 12 stored in the main body 11, through the apertures 13*a* formed on the bottom of the powder puff case 13. However the apertures 13*a* are stopped up quite often and can only supply a small or irregular amount of face powder. In this connection, sufficient face powder does not adhere to the powder puff 15, causing the powder case 10 to be turned upside down and shaken frequently.

A powder puff case having a structure to solve the above-mentioned problems is shown in FIG. 2, which will be schematically explained hereinafter.

FIG. 2 is an exploded, perspective view of another preferred embodiment of a conventional powder case 20, in which a polymer net 21 is mounted separate from a powder puff case 23 for face powder adhesion. The powder case 20 has the same construction as the powder case 10 shown in FIG. 1, except that apertures are not formed on bottom of the powder puff case 23, and the polymer net 21 is additionally provided. Therefore, the same reference numerals throughout FIG. 2 as ones of FIG. 1 designate the equal parts, and a detailed description of them will be omitted.

In using the powder case 20 shown in FIG. 2, a user puts face powder 12 in the powder puff case 23 by using a separate spoon blade, before placing, in order, the polymer net 21 and powder puff 15 in the powder puff case 23. Accordingly, in putting on makeup, a user lifts up the lid 14 and puts his fingers in a tab 15*a* of powder puff 15, and softly hits the polymer net 21. The face powder under the polymer net 21 adheres to the powder puff 15 through meshes of polymer net 21. In this way, the user can powder his face.

As described above, separate from the polymer net 21 the powder puff case 23 is provided in the typical powder case 20 of FIG. 2. When there is no face powder in the powder puff case 23, therefore the polymer net 21 must be lifted out from the powder puff case 23, which must be also detached from the main body 11, before filling the powder puff case 23 with the face powder 12 contained in the main body 11 by using the separate spoon blade.

In addition, due to intense sag (flex caused by being pressed with the powder puff 15) of the polymer net 21, in case where a large amount of face powder 12 lumps together in the powder puff case 23, the face powder does not uniformly adhere to the powder puff 15 through each mesh of polymer net 21 when pressing the polymer net 21 with the powder puff 15.

In this regard, the powder case 20 of FIG. 2 suffers a disadvantage in that face powder needs to be put in the powder puff case very often since the powder puff case 23 and the polymer net 21 are provided independently of each other.

SUMMARY OF THE INVENTION

Accordingly, the present invention is directed to a powder puff case for powder adhesion that substantially obviates one or more of the limitations and disadvantages of the related art.

An object of the present invention is to provide a powder puff case for powder adhesion, in which an adhesion net with specific meshes is integrally formed on its bottom, to permit face powder contained in a main body to directly and uniformly adhere to a powder puff through the adhesion net, by turning upside down and shaking a powder case.

Additional features and advantages of the invention will be set forth in the description which follows, and in part will be apparent from the description, or may be learned by practice of the invention. The objectives and other advantages of the invention will be realized and attained by the structure as illustrated in the written description and claims hereof, as well as the appended drawings.

To achieve these and other advantages, and in accordance with the purpose of the present invention as embodied and broadly described, the powder puff case for powder adhesion is constructed such that face powder in the main body directly and uniformly adheres to the powder puff through the adhesion net when the powder case is turned upside down and shaken.

The adhesion net may be injection-molded at bottom of the powder puff case, or its outer circumference is upward bent to be received at a middle portion of bottom of the powder puff case and a support body is inserted at bottom of the powder puff case to support the outer circumference of the adhesion net. Here, preferably, the adhesion net, the powder puff case, and the support body are in contact with one another by ultrasonic joint.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Reference will now be made in detail to the preferred embodiments of the present invention, examples of which are illustrated in the accompanying drawings.

Figure 3:
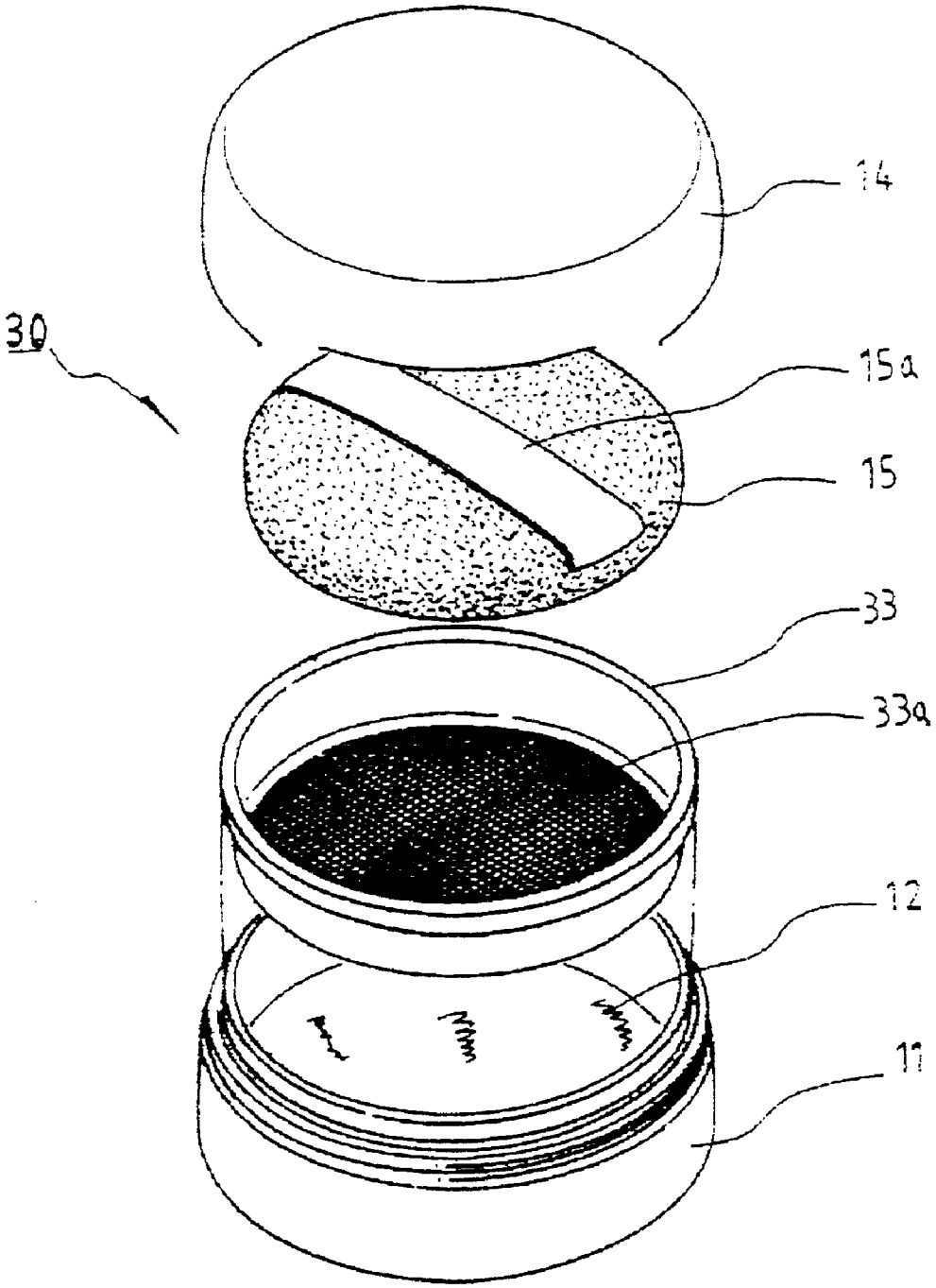
FIG. 3 is an exploded, perspective view of a powder case having a powder puff case in accordance with the present invention.

FIG. 3 is an exploded, perspective view of a powder case 30 including a powder puff case 33 for powder adhesion. The powder case 30 is equal in structure to the powder case 10 shown in FIG. 1, except that an adhesion net 33*a* is integrally formed with the powder puff case 33. The same reference numerals throughout FIG. 3 as ones of FIG. 1 denote the equal parts, and a detailed description of them will be omitted, but a detailed description of essential constituents will be followed.

Figure 4:
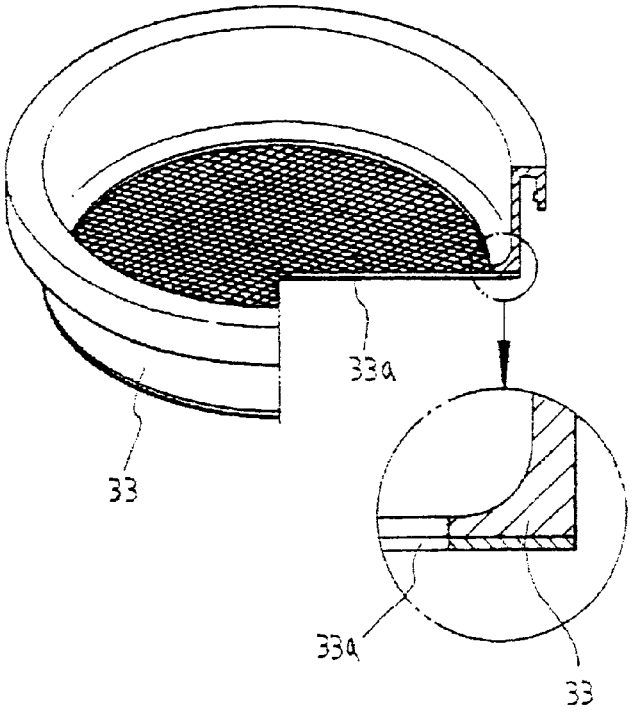
FIG. 4 is a partially broken, perspective view of the powder puff case according to a first preferred embodiment, that is shown in FIG. 3.

The powder puff case 33 according to first preferred embodiment of the present invention, shown in FIG. 4, includes the adhesion net 33*a* that is integrally injection-molded at its bottom, to allow face powder 12 to directly and uniformly adhere to a powder puff 15.

The adhesion net 33*a* integrally formed at the powder puff case 33 may be made of metal such as stainless steel, iron, copper, zinc or aluminum, or made of plastics like polymer. In order to prevent the adhesion net 33*a* from sagging or tearing, it is made of metal rather than plastics. In one embodiment, the adhesion net 33*a* is made with stainless steel that has high intensity and does not gather rust.

Figure 5:
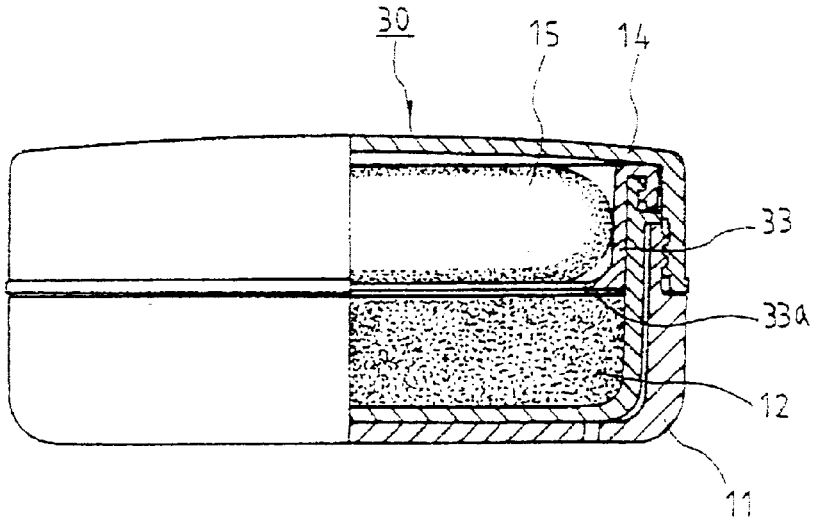
FIG. 5 is a sectional side view of the powder case having the powder puff case in accordance with the first preferred embodiment, that is shown in FIG. 4.

FIG. 5 illustrates a sectional side view of the powder case 30 coupling with the powder puff case 33 in accordance with a first preferred embodiment, where face powder 12 is placed under the adhesion net 33*a*, and the powder puff 15 is positioned on the adhesion net 33*a* in such a way that face powder 12 directly and uniformly adheres to the powder puff 15 by means of the adhesion net 33*a*. In this connection, all a user has to do is to lift up a lid 14 and then powder his face with the powder puff 15 onto which face powder adheres.

Figure 6:
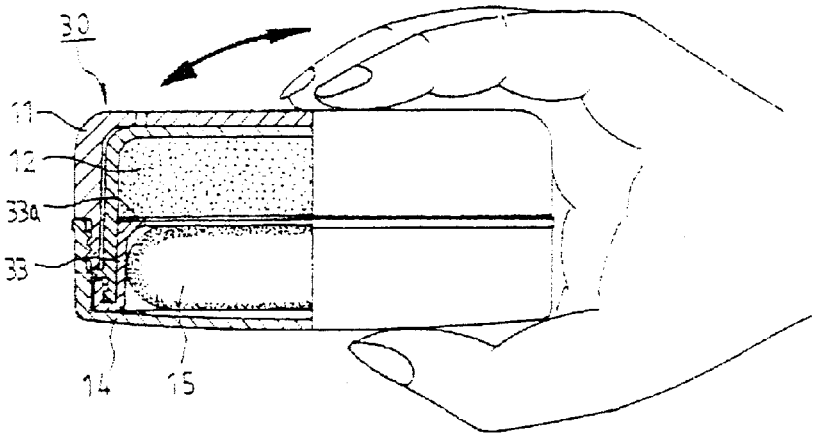
FIG. 6 is a sectional side view of a state in which the powder case of the present invention is turned upside down and shaken.

With reference to FIG. 6, when the powder case 30 is turned upside down and shaken, face powder 12 directly and uniformly adheres to the powder puff 15, through the adhesion net 33*a* integrally formed with the powder puff case 33. Thereafter, the powder case 30 returns to its original position and the lid 14 is taken off the main body 11 of the powder case 30, before touching the face powder that adheres to the powder puff, onto a skin. The adhesion net 33*a* has a netted structure so that its meshes do not clog during powder adhesion, and a uniform amount of face powder 12 is applied to the powder puff 15, thereby preventing loss of powder.

Figure 1:
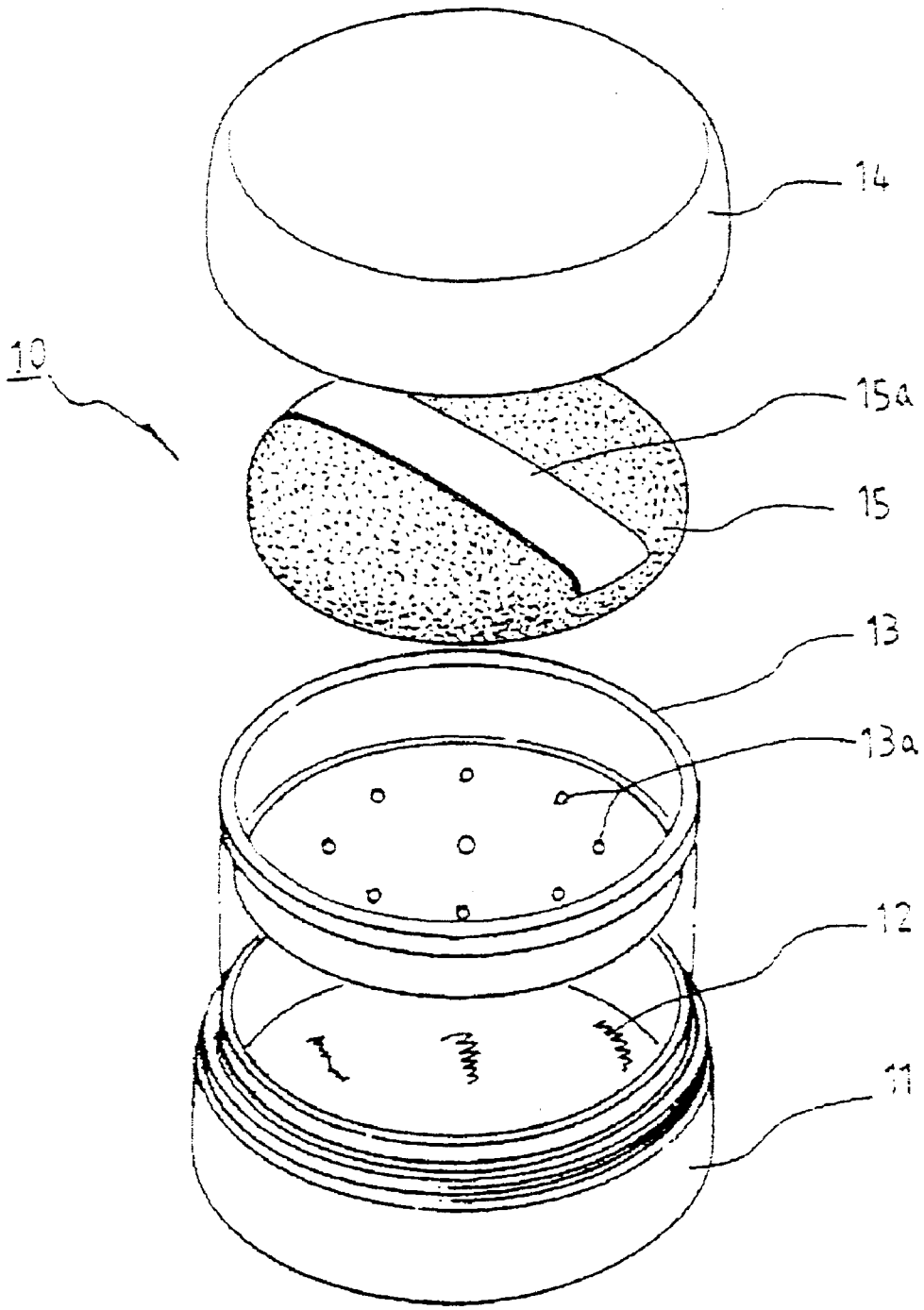
FIG. 1 is an exploded, perspective view of a powder case having a powder puff case for conventional face powder adhesion.
Figure 2:
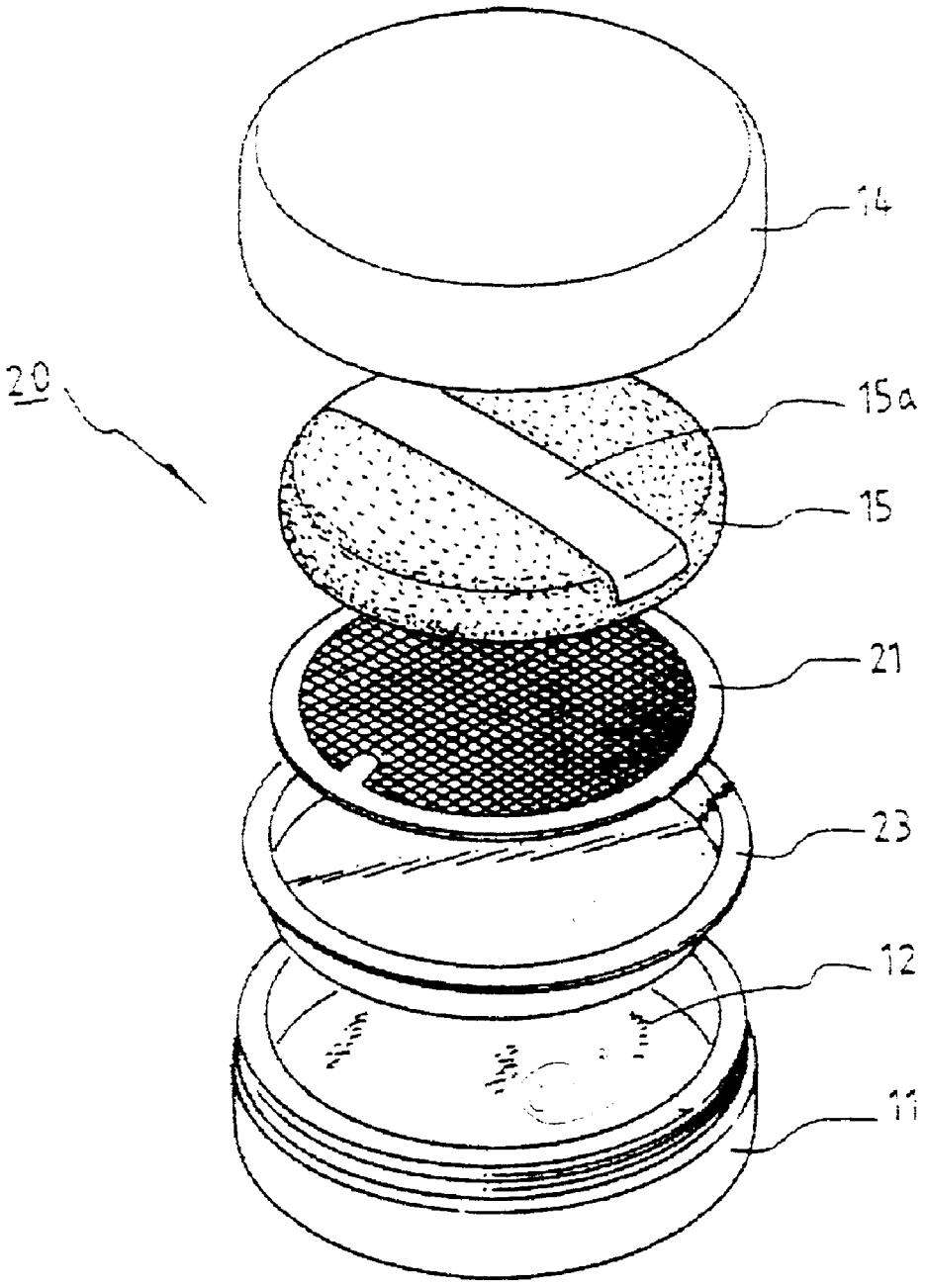
FIG. 2 is an exploded, perspective view of another powder case having a polymer net and a powder puff case for conventional face powder adhesion.

Unlike the conventional powder puff case made of plastics of FIGS. 1 and 2, the powder puff case 33 according to the first preferred embodiment of the present invention prevents apertures from clogging, or face powder from adhering irregularly. In addition, it can remove a great inconvenience that face powder 12 should be quite often put in the powder puff case 13 from the main body 11 by using spoon, since polymer net is provided for uniform face powder adhesion, separate from the powder puff case.

Figure 7:
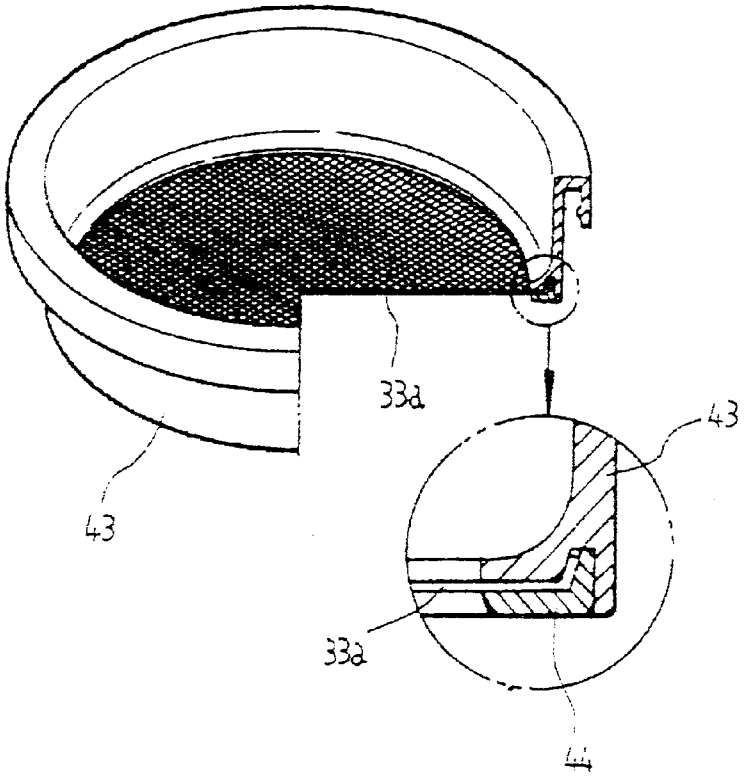
FIG. 7 is a partially broken, perspective view of a powder puff case according to a second preferred embodiment of the present invention.

Referring to FIG. 7 showing a powder puff case 43 according to a second preferred embodiment of the present invention, outer circumference of adhesion net 33*a* for uniform powder adhesion is bent upward to be received into a middle portion of bottom of the powder puff case 43, and a support body 44 is inserted into bottom of the powder puff case 43 to hold the outer circumference of adhesion net 33*a*.

Here, it is preferable to connect the adhesion net 33*a*, the powder puff case 43, and the support body 44 with one another by ultrasonic joint. Besides the ultrasonic joint, they may be connected together by adhesive material, undercut assembly, or heat welding. The powder puff case 43 in accordance with the second preferred embodiment has the same effect as the powder puff case 33 of the first preferred embodiment. This is because they are different only in the way adhesion net 33*a* is attached to the powder puff case.

As described above, the adhesion net is integrally formed with the powder puff case of the present invention. When the powder case is turned upside down and shaken, face powder directly adheres through the adhesion net to the powder puff. Accordingly, there is no necessity for filling the powder puff case with face powder. The powder puff case also has the effect of allowing face powder to uniformly adhere to the powder puff while the meshes of adhesion net are not stopped up, as compared with face powder adhesion through plural apertures.

Furthermore, the powder puff cases 33 and 43 have the advantage that they can be used for a long period of time since the adhesion net 33*a* is made of metal and does not sag or tear.

It will be apparent to those skilled in the art that various modifications and variations can be made in the powder puff case for powder adhesion of the present invention without deviating from the spirit or scope of the invention. Thus, it is intended that the present invention cover the modifications and variations of this invention provided they come within the scope of the appended claims and their equivalents.

For example, the present invention may be applied to babies' powder cases, for drying up babies' skin.

What is claimed is:

1. A powder case comprising:

a main body for containing face powder;

a lid movably connected to the main body;

a powder puff disposed in the main body; and a powder puff case coupled to the main body, the powder puff case comprising:

an integrated adhesion net comprising one of stainless steel, copper, iron, zinc, or aluminum, the integrated adhesion net having an upwardly bent outer circumference inserted into a bottom of the powder puff case; and a support body coupled to the outer circumference of the adhesion net to secure the adhesion net to the powder puff case, wherein the powder puff case, the integrated adhesion net, and support body are held in contact by one of an ultrasonic joint, adhesion material, undercut assembly, or heat welding wherein the integrated adhesion net of the powder puff case is disposed between the powder puff and face powder in the main body, the integrated adhesion net allowing the face powder in the main body to directly and uniformly adhere onto the powder puff when the powder case is turned upside down.

2. A cosmetic container comprising:

a main body; and a powder puff case coupled to the main body, the powder puff case comprising:

an integrated adhesion net having an upwardly bent outer circumference inserted into a bottom of the powder puff case; and a support body coupled to the bottom of the powder puff case, the support body securing the outer circumference of the integrated adhesion net to the powder puff case, thereby preventing the adhesion net from sagging.

3. The cosmetic container of claim 2, wherein the powder puff comprises one of stainless steel, copper, iron, zinc or aluminum.

4. The cosmetic container of claim 2, wherein the powder puff case, the integrated adhesion net, and support body are held in contact by one of an ultrasonic joint, adhesion material, undercut assembly, or heat welding.

5. The cosmetic container of claim 2, further comprising a lid movably coupled to the main body.

6. The cosmetic container of claim 5, further comprising a powder puff disposed between the integrated adhesion net of the powder puff case and the lid.

* * * * *